US006482353B1

(12) United States Patent
Kuniyoshi et al.

(10) Patent No.: US 6,482,353 B1
(45) Date of Patent: Nov. 19, 2002

(54) METHOD FOR MANUFACTURING RARE EARTH MAGNET

(75) Inventors: Futoshi Kuniyoshi, Nishinomiya (JP); Hitoshi Morimoto, Hyogo (JP)

(73) Assignee: Sumitomo Special Metals Co., Ltd. (JP)

( * ) Notice: Subject to any disclaimer, the term of this patent is extended or adjusted under 35 U.S.C. 154(b) by 176 days.

(21) Appl. No.: 09/702,130

(22) Filed: Oct. 31, 2000

(30) Foreign Application Priority Data

Nov. 12, 1999 (JP) ..... 11-323003
Apr. 21, 2000 (JP) ..... 2000-120248

(51) Int. Cl.[7] ..... B22F 3/12
(52) U.S. Cl. ..... 419/38; 419/29; 419/57
(58) Field of Search ..... 419/38, 29, 57

(56) References Cited

U.S. PATENT DOCUMENTS 4,770,723 A 9/1988 Sagawa et al.
4,792,368 A 12/1988 Sagawa et al.
5,250,255 A * 10/1993 Sagawa et al. ..... 419/39
5,383,978 A 1/1995 Yamamoto et al.
5,834,663 A * 11/1998 Fukuno et al. ..... 75/244
6,344,168 B1 * 2/2002 Kuniyoshi ..... 419/36

FOREIGN PATENT DOCUMENTS

JP 63-33505 2/1988
JP 7-18366 1/1995
JP 10-321451 12/1998

* cited by examiner

*Primary Examiner*—Daniel J. Jenkins
(74) *Attorney, Agent, or Firm*—Nixon Peabody LLP; Jeffrey L. Costellia

(57) ABSTRACT

The method for manufacturing an R—Fe—B rare earth magnet of the present invention includes the steps of: compacting rare earth alloy powder having an oxygen content of 4000 wt. ppm or less by dry compacting under compression to produce a compact; impregnating the compact with an oil agent from the surface of the compact; and sintering the compact.

21 Claims, 6 Drawing Sheets

METHOD FOR MANUFACTURING RARE EARTH MAGNET

BACKGROUND OF THE INVENTION

The present invention relates to a method for manufacturing a rare earth magnet, more particularly, to a method for manufacturing a rare earth sintered magnet having an improved magnetic properties using rare earth alloy powder having a reduced oxygen content.

An R—Fe—B rare earth magnet (R is a rare earth element including Y) is mainly constructed of a major phase of an $R_2Fe_{14}B$ tetragonal compound, an R-rich phase including Nd and the like, and a B-rich phase. The magnetic properties of an R—Fe—B rare earth magnet are improved by increasing the proportion of an $R_2Fe_{14}B$ tetragonal compound as the major phase in the magnet.

The R-rich phase is required for liquid-phase sintering. Since R reacts with oxygen in an atmosphere to generate an oxide $R_2O_3$, part of R is wasted without serving for sintering. Therefore, an extra amount of R is required to replace the amount lost to oxidation. The oxide $R_2O_3$ is generated more vigorously as the concentration of oxygen is greater. In view of this, it has been attempted to reduce the concentration of oxygen in an atmosphere in which powder is produced to suppress generation of the oxide $R_2O_3$, and thus improve the magnetic properties of a sintered magnet.

The amount of oxygen in R—Fe—B alloy powder used for an R—Fe—B magnet is preferably as small as possible as described above. However, no method has succeeded in improving the magnetic properties by reducing the amount of oxygen in R—Fe—B alloy powder as a mass production technique. The reason is as follows. If R—Fe—B alloy powder is produced under an environment of a controlled low oxygen concentration and the amount of oxygen in the alloy powder is reduced to 4000 wt. ppm (mass. ppm) or less, for example, the powder may vigorously react with oxygen when the powder is exposed to the atmosphere (the air), causing the possibility of ignition in several minutes at room temperature. Moreover, in the case of adopting hydrogen processing for pulverizing, the alloy starts cracking from the rare earth-rich portions thereof. As a result, rare earth element tends to be exposed on the surfaces of pulverized powder particles. This further facilitates occurrence of ignition.

Therefore, while it has been recognized that the amount of oxygen in R—Fe—B alloy powder should desirably be reduced for improvement of the magnetic properties, it is extremely difficult to handle R—Fe—B alloy powder containing a low concentration of oxygen in a production site such as a plant.

In particular, the risk of ignition is high during a pressing or compacting process where powder is compacted in a press. In this process, the temperature of a compact rises due to heat generated by friction among powder particles during compaction and heat generated by friction between powder particles and the inner side wall of a cavity of the press during ejection of the compact. For prevention of ignition, the surroundings of the press may be put in a non-oxygen atmosphere. This is however unpractical because supply of the alloy powder and removal of the green compact are difficult. Occurrence of ignition may also be avoided if the compacts are swiftly subjected to sintering upon removal from the press. This is however extremely inefficient and thus not suitable for mass production. Also, in mass production facilities, it is difficult to manage compacts under an environment of an extremely low oxygen concentration through the processes from compacting to sintering.

A liquid lubricant such as fatty ester is often added to fines (fine powder) before compacting to improve compressibility or formability of the powder. By this addition of a liquid lubricant, thin oily coatings are formed on the surfaces of powder particles. Such coatings however fail to sufficiently prevent oxidation of the powder having an oxygen concentration of 4000 wt. ppm or less.

For the above reasons, a slight amount of oxygen is intentionally introduced into an atmosphere in which an R—Fe—B alloy is milled, to thereby oxidize thin surfaces of finely milled powder particles and thus reduce the reactivity of the powder. For example, Japanese Patent Publication No. 6-6728 discloses a technique as follows. A rare earth alloy is finely milled under a supersonic inert gas flow containing a predetermined amount of oxygen, so that thin oxide coatings are formed on the surfaces of powder particles produced by the milling. According to this technique, since oxygen in the atmosphere is blocked by the oxide coatings on the powder particles, occurrence of heat generation/ignition due to oxidation is prevented. However, with the existence of the oxide coatings on the surfaces of the powder particles, the oxygen content of the powder increases. This results in increase in the oxygen content (that is, the amount of a rare earth oxide generated) of a sintered body obtained after sintering. This may de-grade the magnetic properties of the resultant sintered magnet.

Japanese Laid-Open Patent Publication No. 10-321451 discloses a technique where R—Fe—B alloy powder having a small oxygen amount is mixed with mineral oil or the like to obtain slurry and a compact is produced from the slurry (wet compacting). Since powder particles in the slurry are kept from contact with the atmosphere, heat generation and ignition are prevented while the small amount of oxygen contained in the R—Fe—B alloy powder is maintained.

The wet compacting method is also adopted broadly for manufacture of ferrite magnets. In the manufacture of ferrite magnets, water is used for producing slurry. In the manufacture of R—Fe—B alloy magnets, however, use of water is difficult because R—Fe—B alloy powder reacts with water. This is the reason why an oil agent such as mineral oil is used. For R—Fe—B alloy magnets, a mineral oil or the like having comparatively low volatility is often used so as to reduce the amount of the oil agent that volatilizes from the slurry.

The above conventional technique has the following problem. After the R—Fe—B alloy powder in the slurry state is filled in a cavity of a press, the oil must be squeezed out during the pressing of the powder. This lowers productivity.

It is known that the magnetic properties degrade as the amount of carbon in an R—Fe—B sintered magnet increases. Therefore, in order to obtain a rare earth magnet having excellent magnetic properties after sintering, deoiling at high temperature is required to volatilize the oil agent used for formation of the slurry. In the above conventional technique, after production of a compact, the oil agent remains over the entire compact and moreover the amount of the oil agent contained in the compact is large. Therefore, it takes longer time to complete deoiling, and thus productivity decreases.

An object of the present invention is providing a method for manufacturing a rare earth magnet safely and efficiently using rare earth alloy powder having a low oxygen concentration.

SUMMARY OF THE INVENTION

The method for manufacturing an R—Fe—B rare earth magnet of the present invention includes the steps of: compacting rare earth alloy powder having an oxygen content of 4000 wt. ppm or less by dry compacting under compression to produce a compact; impregnating the compact with an oil agent from the surface of the compact; and sintering the compact.

The mean particle size of the rare earth alloy powder is preferably 10 $\mu$m or less.

The rare earth alloy powder is preferably placed in an inert gas atmosphere having an oxygen concentration of 5000 vol. ppm or less until the powder is filled in a cavity of a press for production of the compact.

A vapor pressure of the oil agent is preferably 8 Pa or more at a temperature of 20° C. The oil agent may be a volatile oil.

The temperature of the compact may be reduced at least temporarily due to volatilization of the oil agent.

The oil agent preferably includes a hydrocarbon solvent such as isoparaffin. A saturated hydrocarbon solvent is more preferable.

A lubricant is preferably added to the rare earth alloy powder before the compacting step.

The oil agent may be substantially removed from the compact before the compact is sintered. In this case, after the removal of the oil agent, the compact is preferably kept from contact with the atmosphere until the compact is sintered.

The removal of the oil agent is preferably performed under a reduced pressure at a temperature of 100 to 600° C. for 0.1 to 8.0 hours.

In a preferred embodiment, after the compacting step, a surface temperature of the compact is measured, and the impregnation step is carried out only if the surface temperature is below a predetermined level. The surface temperature of the compact is preferably measured with an infrared thermometer. The compact of which the surface temperature is equal to or above the predetermined level is preferably stored in a sealable collecting box.

In a preferred embodiment, the impregnating step is carried out using an impregnation bath including openings through which the compact is put in and taken out and shutters for closing the openings.

A plurality of impregnation baths filled with the oil agent may be used, so that a predetermined number of compacts are individually put in the impregnation baths, to carry out the impregnation step.

At least one impregnation bath is preferably provided with a chiller for cooling the oil agent.

At least one impregnation bath is preferably provided with a thermometer for measuring the temperature of the oil agent.

In a preferred embodiment, after the impregnating step, the compact is placed on a sintering plate in an inert atmosphere before sintering. Alternatively, after the impregnating step, the compact may be stored in a sintering case in an inert atmosphere before sintering.

The "oil agent" as used herein means hydrophobic liquid including a hydrocarbon solvent, a lubricant, and the like.

DETAILED DESCRIPTION OF THE INVENTION

Figure 1:
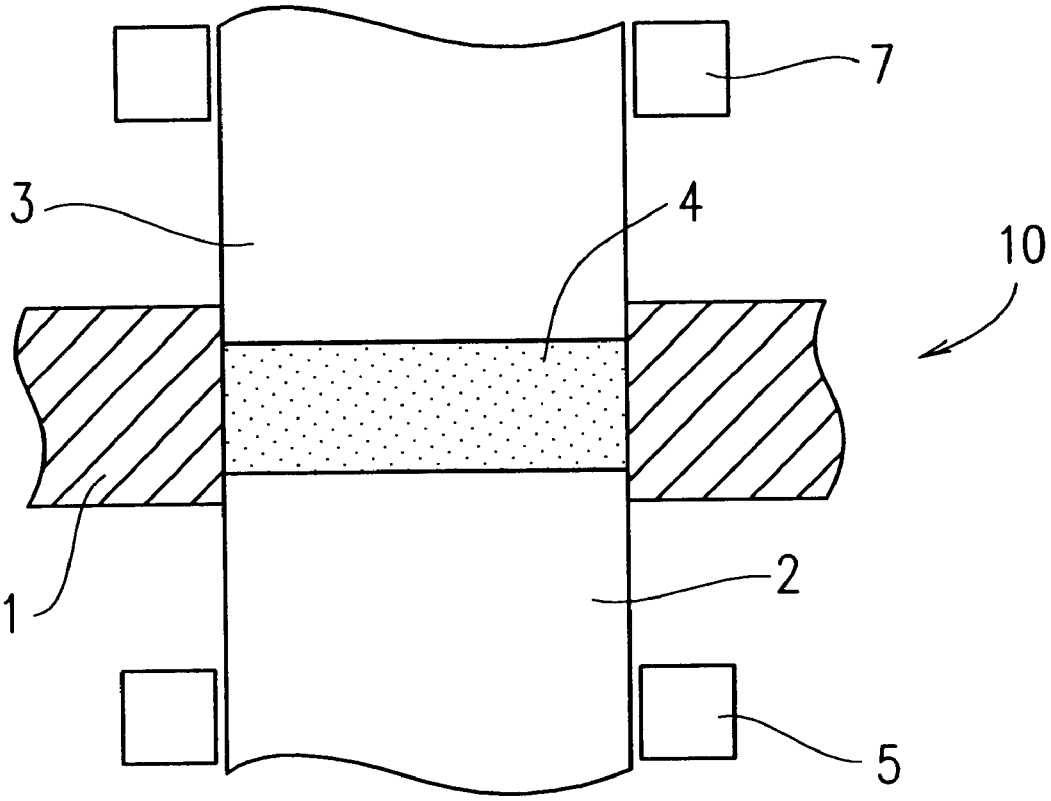
FIG. 1 is a schematic cross-sectional view of a press suitably used for compacting of magnetic powder.

Hereinafter, a preferred embodiment of the method for manufacturing a rare earth magnet of the present invention will be described with reference to the relevant drawings.

First, produced is molten alloy (molten mass) of an R—Fe—B alloy containing 10 to 30 at % of R (at least one kind of the rare earth elements containing Y), 0.5 to 28 at % of B, and Fe as the remainder, together with inevitably contained impurities. Either one or both of Co and Ni may be substituted for part of Fe, or C may be substituted for part of B. According to the present invention, the oxygen content is reduced and thus production of an oxide of the rare earth element R is suppressed. Therefore, the content of the rare earth element R can be reduced to the minimum necessary value. As compositions of the R—Fe—B alloy used for this embodiment, those described in U.S. Pat. Nos. 4,770,723 and 4,792,368 are available.

The molten alloy is then quenched and solidified into a shape of thin plates (or ribbons) having a thickness of 0.03 to 10 mm at a cooling rate of $10^2$ to $10^{4}$° C./sec by appropriate quenching method such as strip casting (or melt spinning), to form cast pieces having a structure where the R-rich phase having a fine size of 5 $\mu$m or less is dispersed. The cast pieces accommodated in a case are placed in a chamber allowing for air intake and outlet. After evacuation of the chamber, $H_2$ gas with a pressure of 0.03 to 1.0 MPa (megapascal) is supplied into the chamber, to form disintegrated alloy powder. The disintegrated alloy powder is dehydrogenated and then finely milled under inert gas flow.

The cast pieces as a magnet material used in the present invention can be produced appropriately by quenching the molten alloy of a specific composition by strip casting using a single roll method or a twin roll method. The use of the single roll method or the twin roll method may be determined depending on the thickness of the cast pieces to be produced. The twin roll method is preferably used when thick cast pieces are to be produced, while the single roll method is preferably used when thin cast pieces are to be produced. Centrifugal casting may be adopted as the quenching method in place of the strip casting. When the alloy is produced by a quenching method, a fine and uniform grain size is obtained for the major phase of the alloy. Therefore, the coercive force is improved compared with an alloy of the same composition produced by ingot casting.

If the thickness of the cast pieces (flake-like alloy) is less than 0.03 mm, the quenching effect is great. This may presumably reduce the crystal grain size excessively. If the crystal grain size is excessively small, powder particles individually have a polycrystalline structure when the cast pieces are powdered. This results in failure to align the crystal orientation and thus degradation of the magnetic properties. If the thickness of the cast pieces exceeds 10 mm, the cooling rate decreases, resulting in that α-Fe is easily crystallized out and also the Nd-rich phase is unevenly distributed.

The hydrogen processing for embrittlement is performed in the following manner, for example. The cast pieces crushed to a predetermined size are put in a material case, and the material case is placed in a sealable hydrogen furnace, which is then sealed. After sufficient evacuation of the hydrogen furnace, hydrogen gas with a pressure of 30 kPa to 1.0 MPa is supplied into the furnace, to allow the cast pieces to occlude hydrogen. Since the hydrogen occlusion is exothermic reaction, cooling piping for flowing cooling water is preferably provided around the furnace to prevent temperature rise in the furnace. The cast pieces spontaneously disintegrate by the hydrogen occlusion to be embrittled (or partially powdered).

The alloy being subjected to the hydrogen occluding is cooled and dehydrogenated by heating under vacuum. The dehydrogenated alloy powder particles have micro cracks. Such particles can be finely milled in a short time during subsequent milling with a ball mill, a jet mill, or the like. Thus, alloy powder with a predetermined granular variation (particle size distribution) can be produced. A preferred embodiment of the hydrogen embrittlement is disclosed in Japanese Laid-Open Patent Publication No. 7-18366.

The above fine milling is preferably performed with a jet mill using inert gas ($N_2$, Ar, etc., for example). Alternatively, it may be performed with a ball mill or an attriting apparatus using an organic solvent (benzene, toluene, etc., for example).

During the above milling, the oxygen concentration of an atmospheric gas is preferably controlled at a low value (5000 vol. ppm or less, for example) so that the amount of oxygen contained in the powder is kept small.

It is preferable to add to the material alloy powder a liquid lubricant or a binder containing fatty ester and the like as a major ingredient. The added amount is 0.15 to 5.0 mass %, for example. Examples of the fatty ester include methyl caproate, methyl caprylate, and methyl laurate. Important is that the lubricant should volatilize in a subsequent process and be removed. If the lubricant itself is a solid that is not easily mixed with the alloy powder uniformly, the lubricant may be diluted with a solvent. As such a solvent, a petroleum solvent represented by isoparaffin, a naphthenic solvent, and the like may be used. The lubricant may be added at an arbitrary timing, which may be before, during, or after the milling. The liquid lubricant provides the effect of protecting the powder particles from being oxidized by covering the surfaces of the particles. In addition, the liquid lubricant provides the function of equalizing the density of a compact during pressing and thus suppressing disorder of orientation.

Next, magnetic aligning and compacting are performed with a press shown in FIG. 1. A press 10 in FIG. 1 includes a die 1 having a through hole and punches 2 and 3 for blocking the through hole of the die 1 from below and above. Material powder 4 is filled in a cavity defined by the die 1, and the lower punch 2, and compacted by reducing the gap between the lower punch 2 and the upper punch 3 (pressing process). The press 10 in FIG. 1 also includes coils 5 and 7 for generating aligning magnetic field.

The filling density of the powder 4 is set to fall within a range where magnetic alignment can be performed for the powder and after removal of the magnetic field, the alignment of the magnetic powder is less easily disordered. In this embodiment, the filling density is preferably in the range of 30 to 40% of the true density, for example.

After the powder filling, a magnetic field is applied to the space filled with the powder 4, to magnetically align the powder 4. This is effective not only for parallel magnetic field compacting where the direction of the magnetic field matches the pressing direction, but also for vertical magnetic field compacting where the direction of the magnetic field is vertical to the pressing direction. The density of the compact is set to fall within the range of 3.6 to 4.8 g/cm$^3$ so that the compact has a sufficient strength for the following impregnation step.

Figure 2:
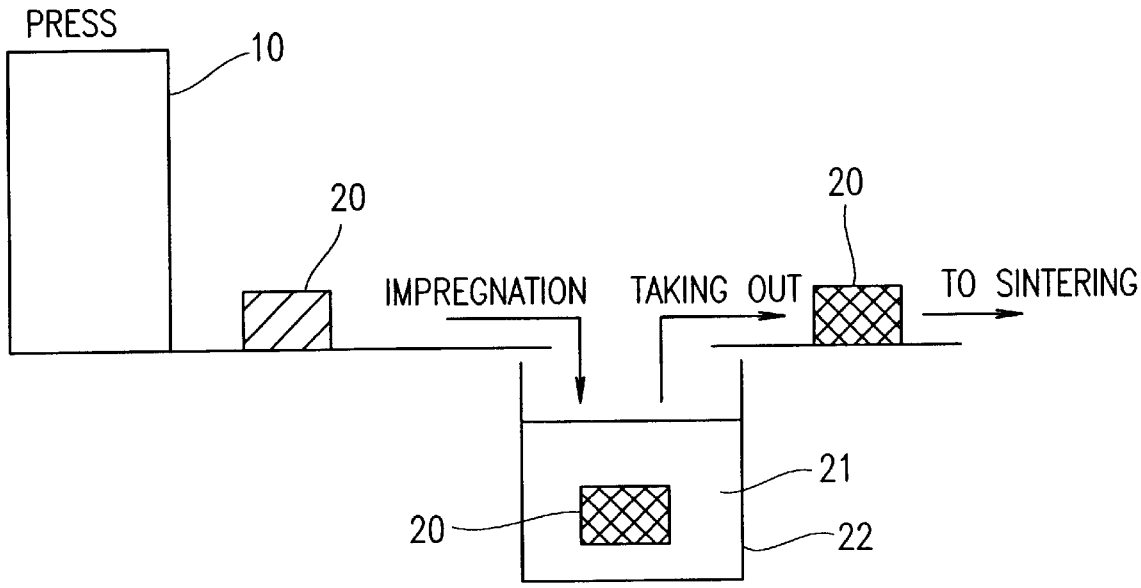
FIG. 2 is a diagram illustrating an impregnation process used for an embodiment of the present invention.

After being removed from the press 10 in FIG. 1, the compact is immediately impregnated with an oil agent such as an organic solvent. FIG. 2 illustrates an impregnation process. In this embodiment, a solvent of saturated hydrocarbon such as isoparaffin is used as the solvent with which a compact 20 is impregnated. An organic solvent 21 is filled in a bath 22 as shown in FIG. 2 to allow the compact 20 to be immersed in the organic solvent 21 in the bath 22. The compact 20 is impregnated or soaked with the organic solvent 21 from the surface of the compact 20 (i.e., the surface that defines the shape of the compact 20) and thus substantially covered with the organic solvent. This suppresses the compact 20 from being in direct contact with oxygen in the atmosphere. Therefore, the possibility of heat generation/ignition of the compact 20 in a short time is greatly reduced even if the compact 20 is left in the atmosphere.

In this impregnation process, it is not necessary to cover the surfaces of all the powder particles of the compact with the solvent. Even if only a thin surface region of the compact is impregnated with the solvent, reaction of the compact with oxygen in the atmosphere can be prevented. The solvent coating of the powder particles within the surface region of the compact can provide a sufficient barrier for oxidation. Furthermore, it is not necessary to fill voids or pores in the compact with the solvent.

A half second or longer is enough as the duration (immersing time) of the compact being immersed or soaked in the organic solvent 21. As the immersing time is longer, the amount of the organic solvent contained in the compact is larger. However, this does not cause problems such as collapse of the compact. Therefore, the compact may be kept immersed in the organic solvent, or the impregnation process may be repeated a plurality of times, until the sintering process starts.

As the organic solvent used for the impregnation, the same material as the liquid lubricant added to the powder for improving the formability and the degree of magnetic alignment may be used. The organic solvent is required to have a function of preventing surface oxidation. In consideration of this, particularly preferred as the organic solvent are petroleum solvents represented by isoparaffin, naphthenic solvents, fatty esters such as methyl caproate, methyl caprylate, and methyl laurate, higher alcohols, higher fatty acids, and the like.

The organic solvent used for the impregnation process is not limited to the saturated hydrocarbon solvents, but unsaturated hydrocarbon solvents made of α-pinene, cyclobutene, cyclohexene, diethylbenzene, and the like may be used. However, unsaturated hydrocarbon solvents may possibly react with the powder particles that are in the state of exposing their active surfaces after the milling process. It is therefore preferable to use saturated hydrocarbon solvents.

After the impregnation, the compact 20 is subjected to known manufacturing processes including preheating (oil removing), sintering, and aging, to be finally completed as a permanent magnet product. Carbon (C) contained in the oil agent degrades the magnetic properties of the resultant rare earth magnet. Therefore, as the oil agent with which the compact 20 is impregnated, one that is easily removed from the compact during preheating and/or sintering is selected. The oil agent is therefore prevented from adversely influencing the magnetic properties of the sintered magnet. Preferably, the oil agent has a vapor pressure of 8 Pa or more at a temperature of 20° C. After volatilization of the oil agent during preheating and the like, the compact must be placed under an environment of a low oxygen concentration without being put in contact with the atmosphere. For this purpose, furnaces for preheating and sintering are preferably directly coupled so that the compact can be moved between the furnaces without direct contact with the atmosphere. A continuous furnace is desirable.

By using the organic solvent as those described above, the necessity of using hydrogen gas and the like during preheating is eliminated since carbon contained in the organic solvent is easily removed. This enables the oil removing process to be completed in a shorter time compared with the case of using mineral oil, and thus improves productivity. Preferably, the removal of the oil agent is performed under a reduced pressure at a temperature of 100 to 600° C. for 0.1 to 8.0 hours.

In this embodiment, the material alloy was produced by strip casting as described in U.S. Pat. No. 5,383,978. Alternatively, other methods (ingot casting, direct reduction, atomizing, and centrifugal casting, for example) may be adopted.

Figure 5:
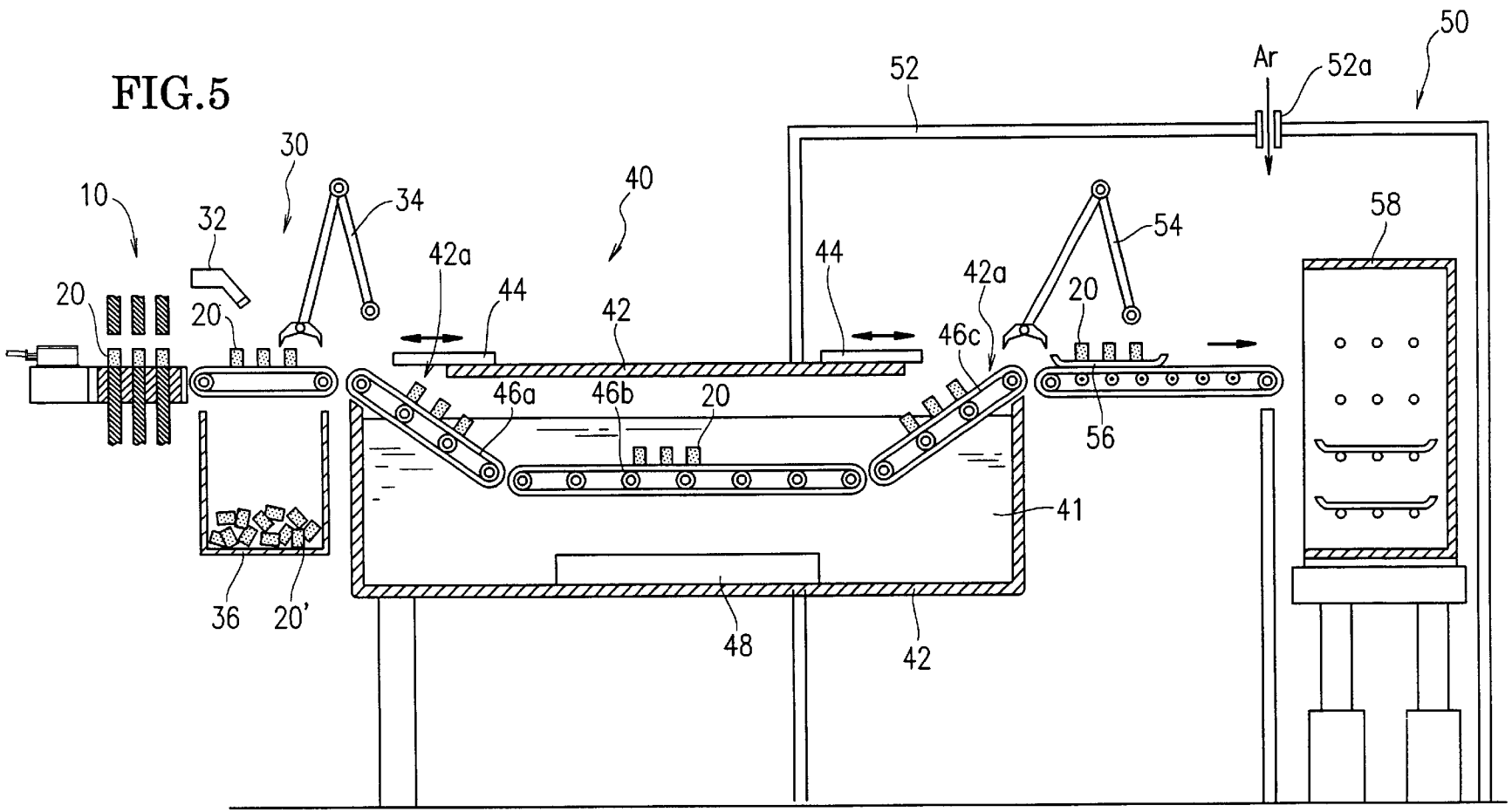
FIG. 5 is a diagram illustrating a press, an impregnation bath, a sintering case, and the like used for another embodiment of the present invention.

Another embodiment of the method for manufacturing a rare earth magnet of the present invention will be described with reference to FIG. 5. FIG. 5 illustrates a press 10, an impregnation bath 42, a sintering case 58, and the like. In this embodiment, a compact 20 produced with the press 10 is transported to a temperature detection section 30, where an infrared thermometer 32 measures the surface temperature of the compact 20 after pressing. The infrared thermometer 32 can measure the temperature of the compact 20 swiftly and easily without the necessity of direct contact with the compact 20.

If the surface temperature of the compact 20 measured with the thermometer 32 is equal to or more than a predetermined level (40° C. or 45° C., for example), the compact 20 is thrown into a collecting box 36 with a sorting device 34 (a robot arm, for example) without being impregnated with the oil agent. The collecting box 36 is preferably composed of an openable sealed vessel and preferably disposed near the transportation route of the compact 20. With this construction, if a discarded compact 20' would ignite, the compact 20' can be sealed inside the collecting box 36 and blocked from the ambient atmosphere (oxygen and steam), whereby the ignition can be extinguished. In order to facilitate extinguishing the ignition, the collecting box 36 may be filled with inert gas such as nitrogen gas.

If the surface temperature of the compact 20 measured is below the predetermined level, the compact 20 is transported to an impregnation section 40, which includes the impregnation bath 42 filled with an oil agent 41. The impregnation bath 42 has openings 42*a* closable with shutters 44 on both ends of the top surface thereof. With this construction, the compacts 20 are allowed to enter and exit the impregnation bath 42, and yet the impregnation bath 42 can be substantially sealed. A chiller 48 is provided inside the impregnation bath 42 for cooling the oil agent 41. The chiller 48 is controlled so that the temperature of the oil agent 41 is kept from rising to a level at which the risk of ignition is high. The inside of the impregnation bath 42 may be put in an inert atmosphere, so that the work can be done more safely.

The compact 20 transported to the impregnation section 40 is immersed into the oil agent 41 while being carried on a downward belt 46*a* extending from the opening 42*a* on one end of the impregnation bath 42 to the inside of the bath 42. The immersed compact 20 is moved in the oil agent 41 while being carried on a translation belt 46*b*. During this movement, the compact 20 is impregnated with the oil agent 41 from the surface thereof. The compact 20 is then moved out from the oil agent 41 while being carried on an upward belt 46c extending from the inside the bath 42 to the opening 42*a* on the other end.

In the above impregnation process, the compacts 20 having a temperature of about 40° C. are sequentially immersed in the oil agent 41 in the impregnation bath 42. This gradually raises the temperature of the oil agent 41, and thus part of the oil agent 41 may possibly vaporize. In order to block vaporized oil agent 41 from being released outside the bath, the openings 42*a* of the impregnation bath 42 can be closed with the shutters 44. In addition, if the oil agent 41 would be ignited due to the temperature rise, flames can be confined within the bath 42 by closing the openings 42*a* with the shutters 44. This increases the safety. If the inside of the impregnation bath 42 is put in an inert gas atmosphere, ignition of the compact 20 can be suppressed more effectively.

Moreover, by appropriately operating the chiller 48, the temperature of the oil agent 41 can be maintained at a predetermined value (roughly room temperature, for example) even if it rises due to the temperature of the compacts 20. A thermometer may be provided for monitoring the temperature of the oil agent 41 inside the impregnation bath 42. The operation of the chiller 48 may be controlled automatically based on the temperature of the oil agent 41 measured with the thermometer.

After the impregnation process, the compact 20 impregnated with the oil agent 41 is transported to a sintering preparation section 50 for preparation for sintering of the compact 20. The sintering preparation section 50 is preferably located inside a space substantially blocked from the external atmosphere with a partition 52. In the sintering preparation section 50, the compacts 20 are placed on a sintering plate 56 in a desired arrangement by means of a placing device 54 (a robot arm, for example). The sintering plate 56 with a predetermined number of compacts 20 placed thereon is then stored in the sintering case 58.

In the sintering preparation process, inert gas such as argon, for example, is supplied into the space surrounded by the partition 52 via an opening 52*a*. By performing the above operation of placing the compacts 20 on the sintering plate 56 and then storing in the sintering case 58 in the inert gas atmosphere, the compacts 20 are suppressed from being oxidized.

Thus, in this embodiment, an igniting compact or a compact that is just to ignite is prevented from being immersed in the impregnation bath. This prevents the oil agent in the impregnation bath from being excessively heated and thus prevents the oil agent from being ignited. In the case of compacting rare earth alloy powder having a low oxygen concentration, the possibility of heat generation/ ignition is highest when the resultant compact is ejected from the cavity of the die of the press. In this embodiment, ignition of the oil agent is reliably prevented, and thus the impregnation process can be carried out safely.

Figure 6:
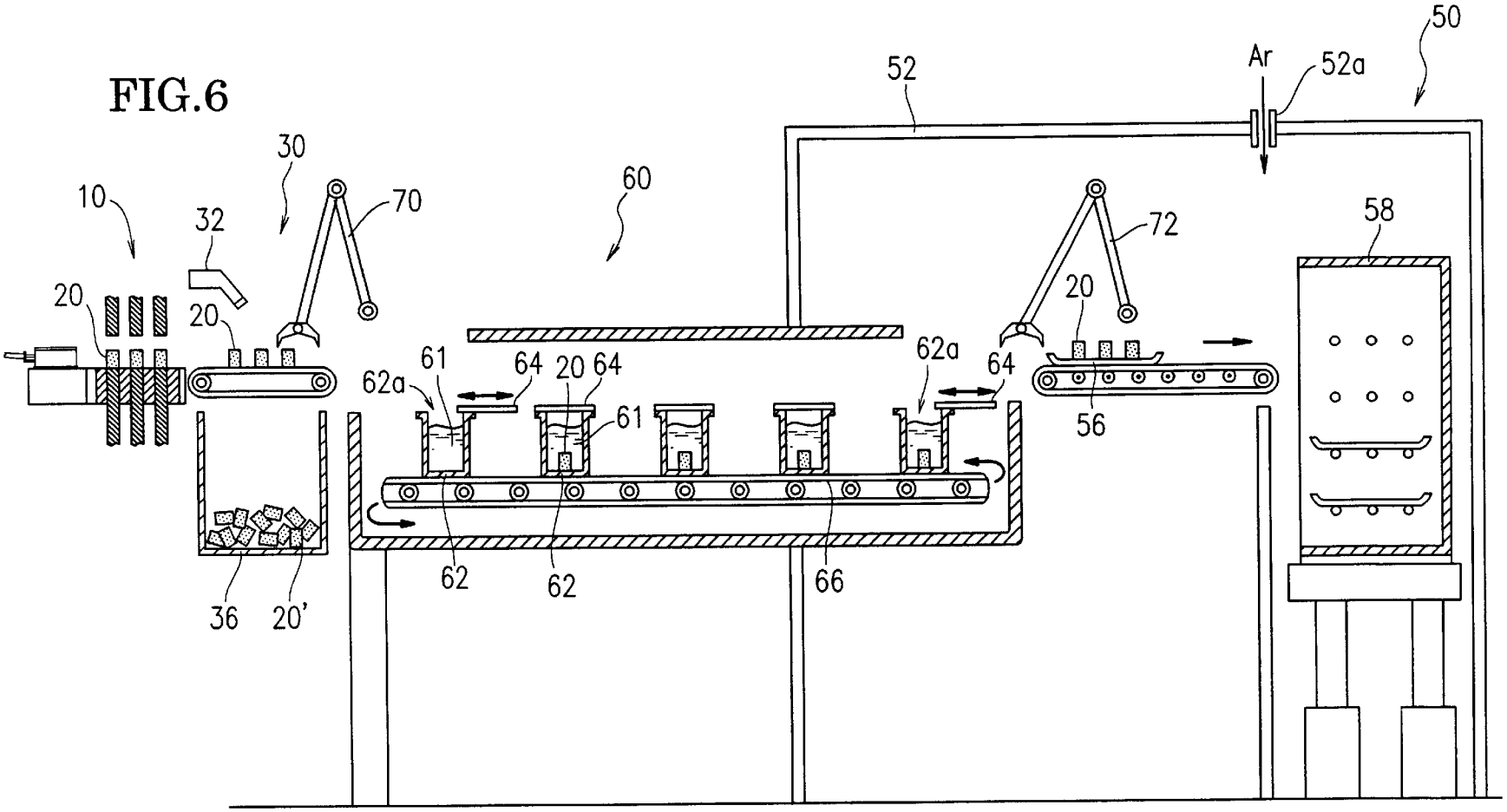
FIG. 6 is a diagram illustrating a press, an impregnation bath, a sintering case, and the like used for yet another embodiment of the present invention.

A yet another embodiment of the method for manufacturing a rare earth magnet the present invention will be described with reference to FIG. 6. In this embodiment, as in the previous embodiment shown in FIG. 5, if the surface temperature of the compact 20 measured with the infrared thermometer 32 is equal to or more than a predetermined level (50° C., for example), the compact 20 is thrown into the collecting box 36 without being impregnated with an oil agent 61. If the measured surface temperature is below the predetermined level, the compact 20 is passed to the process of impregnation with the oil agent 61. This embodiment is different from the embodiment shown in FIG. 5 in that an impregnation section 60 includes a plurality of impregnation baths (containers) 62.

The compact 20 is thrown into the collecting box 36 or transported to the impregnation section 60 with a sorting/inserting device 70 composed of a robot arm and the like. The sorting/inserting device 70 operates to immerse the compact 20 into the oil agent 61 filled in one of the impregnation baths 62 only when the surface temperature of the compact 20 measured with the thermometer 32 is below a set level.

The plurality of impregnation baths 62 are carried on a rotary conveyor 66 circulating in a roughly horizontal plane. A shutter 64 is provided for each of the impregnation baths 62. The impregnation bath 62 receives the compact 20 dropped or put therein through an opening 62*a* with the shutter 64 being open. In the example illustrated in FIG. 6, one impregnation bath 62 receives one compact. Alternatively, one impregnation bath 62 may receive a plurality of compacts. Each of the impregnation baths 62 carrying the compact inside is moved on the conveyor 66 with the shutter 64 being closed. During the movement, the compact 20 is impregnated with the oil agent 61. After the impregnation, the shutter 64 is opened, and the compact 20 is picked out from the impregnation bath 62 through the opening 62*a* to be placed on the sintering plate 56. This operation is performed with a picking/placing device 72 including a robot arm as shown in FIG. 6, for example. The sintering plate 56 with the compacts 20 placed thereon is then stored in the sintering case 58 to be ready for a known sintering process.

In this embodiment, it is possible to close the opening 62*a* with the shutter 64 all the time except for the time when the compact 20 is put in and taken out. Therefore, vaporized part of the oil agent is less easily released outside the impregnation bath 62. Moreover, if the oil agent in the impregnation bath 62 would be ignited, flames can be easily confined within the bath 62. Furthermore, in this embodiment, the compacts 20 are impregnated separately in the plurality of impregnation baths 62 of a comparative small size. Therefore, if the oil agent in one of the plurality of impregnation baths 62 would be ignited, the other impregnation baths 62 will be free from the influence of the ignition. This further improves the safety. In order to ensure the control of the temperature of the oil agent within a safety range, each of the impregnation baths 62 is preferably provided with a chiller (not shown).

In the above embodiments, a plurality of compacts 20 are put in the comparatively large sintering case 58. The present invention is not limited to this construction. For example, the compacts 20 may be stored in a smaller box-shaped sintering pack, and a stack of such sintering packs may be transported to a sintering furnace. Alternatively, the sintering plate 56 with the compacts 20 placed thereon may be transported to a sintering furnace without being sealed especially. In any case, the process of placing the compacts on the sintering plate 56 is preferably carried out in an inert gas atmosphere.

EXAMPLE

First, molten alloy having a composition of Nd+Pr (30 mass %), Dy (1.0 mass %), B (1.0 mass %), Al (0.1 mass %), and Fe (remainder) was produced in a high-frequency melting crucible. The molten alloy was then cooled with a roll-type strip caster to produce thin plate-shaped cast pieces (flake-like alloy) having a thickness of 0.3 to 0.5 millimeters. The concentration of oxygen contained in the flake-like alloy was 150 wt. ppm.

The flake-like alloy accommodated in a case was then placed in a hydrogen furnace. After evacuation of the furnace, hydrogen gas was supplied into the furnace for two hours for hydrogen embrittlement. The hydrogen partial pressure in the furnace was set at 200 kPa. After the flakes spontaneously disintegrate by the hydrogen occlusion, the furnace was evacuated while heating, to execute dehydrogenation. Argon gas was then introduced into the furnace, and the furnace was cooled to room temperature. The alloy was removed from the hydrogen furnace when the temperature of the alloy was lowered to 20° C. At this stage, the oxygen content of the alloy was 1000 wt. ppm.

The resultant alloy was milled with a jet mill that was controlled so that the oxygen concentration in a milling chamber thereof was 0.5 vol. % (5000 vol. ppm) or less, to produce powder having a mean particle size of 4.4 $\mu$m (material 1) and powder having a mean particle size of 4.0 $\mu$m (material 2). In this way, by milling the alloy in an atmosphere having a controlled low oxygen concentration, the surfaces of the resultant milled powder particles were successfully suppressed from being oxidized. The concentrations of oxygen contained in material 1 and material 2 were about 3000 wt. ppm and about 2000 wt. ppm, respectively. That is, the concentration of the contained oxygen was 3000 wt. ppm or less in both cases. Note that the "mean particle size" as used herein indicates the mass median diameter.

Thereafter, 0.4 mass % of a liquid lubricant was added to the above finely milled powder (material 1 and material 2) with a rocking mixer. As the lubricant, one containing methyl caproate as a major ingredient was used.

The above powder was then compacted by dry compacting with the machine shown in FIG. 1 to produce a compact. The "dry" type as used herein is broadly defined as including the case as in this example where the powder contains a comparatively small amount of a lubricant (oil agent) as long as the process of squeezing an oil agent is not necessary.

Two compacts were produced from material 1, and one compact from material 2. The size was 30 mm×50 mm×30 mm and the density was 4.3 to 4.4 g/cm$^3$ for all of these compacts.

The compacts were then impregnated with an oil agent from the surfaces thereof. Isoparaffin was used as the oil agent. The compacts were entirely immersed in the oil agent for two seconds.

Each compact taken out from the oil agent was left to stand in the atmosphere at room temperature, and then the temperature of the compact was measured. Heat is generated when a rare earth element in the compact is oxidized. By measuring the temperature of the compact, therefore, the progress of the oxidation can be evaluated.

Figure 3:
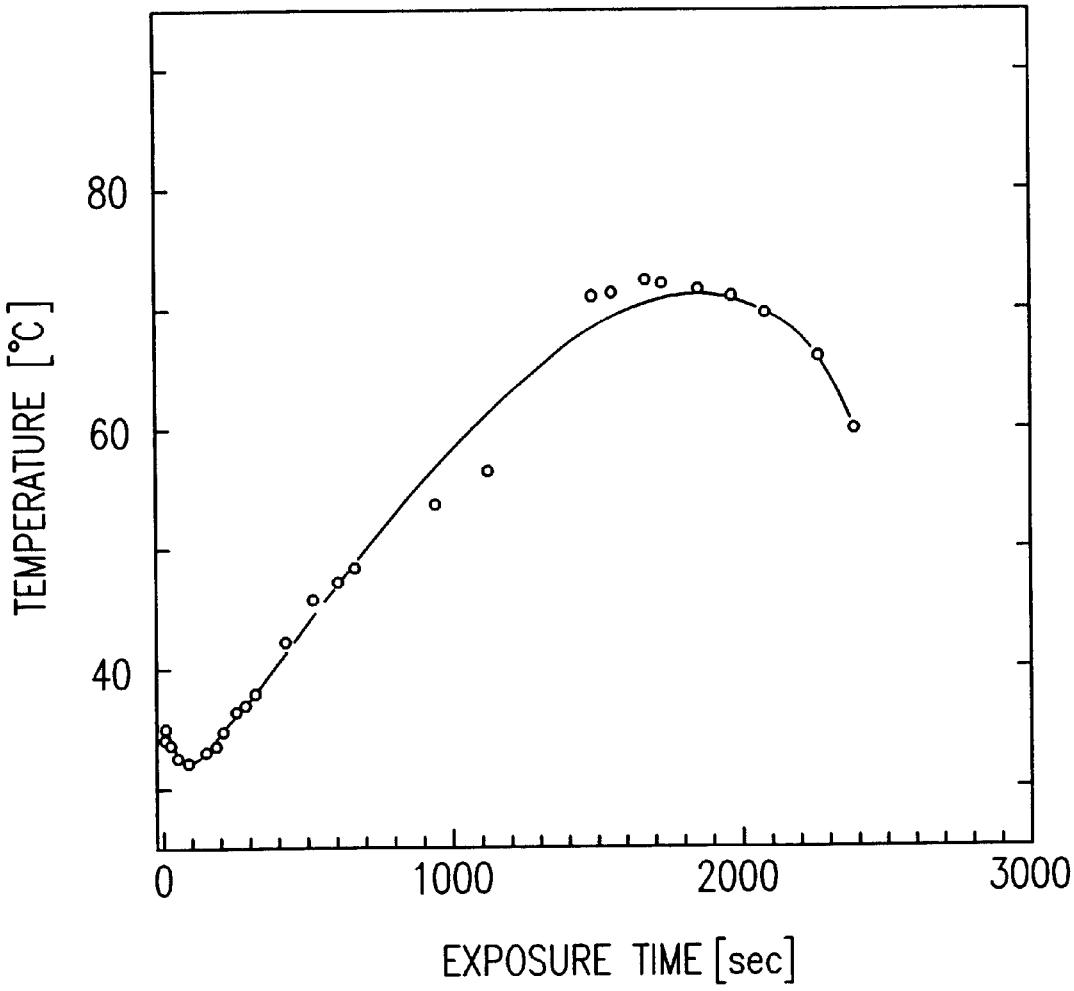
FIG. 3 is a graph showing the relationship between the elapsed time after impregnation and the compact temperature in an example of the present invention.

FIG. 3 is a graph showing the relationship between the exposure time to the atmosphere and the temperature of the compact. The atmospheric temperature was room temperature (25° C.) and the humidity was 40%. As is apparent from FIG. 3, the compact temperature was 40° C. or less immediately after the impregnation, and was still below 50° C. after a lapse of 600 seconds. The temperature rise of the compact was stopped after a lapse of about 2000 seconds. The maximum temperature of the compact was as low as about 70° C. This means that the compact would not have ignited if it had been left in the atmosphere for a long time.

It was also found that the compact temperature temporarily dropped (for about two to three minutes) after the impregnation. This is because the compact was cooled due to vaporization heat of the oil agent vaporized from the compact. A volatile oil may be used as the oil agent.

Thereafter, the compact of which the surface was covered with the oil agent was subjected to two-hour preheating at 250° C. and then six-hour sintering at 1040° C.

The thus-manufactured sintered magnets were evaluated for various magnetic properties. As a result, for a sintered magnet made from material 1, the oxygen content was 3100 wt. ppm, the residual magnetic flux density Br was 1.41 T, the maximum magnetic energy product $(BH)_{max}$ was 380 kJ/m, and the coercive force $H_{cj}$ was 1000 kA/m. For a sintered magnet made from material 2, the oxygen content was 2200 wt. ppm, the residual magnetic flux density Br was 1.43 T, the maximum magnetic energy product $(BH)_{max}$ was 397 kJ/m, and the coercive force $H_{cj}$ was 1000 kA/m.

In comparison with the sintered magnets made from material 1 and material 2, it is found that the magnetic properties improve by reducing the oxygen content.

As the method for impregnating the compact with an oil agent, spraying, brushing (dabbing), or the like may be employed in place of the method used in this example. In such a case, also, substantially the same effect can be obtained.

The composition of the material of the rare earth magnet used in the present invention is not limited to that specified in this example. The present invention is broadly applicable to rare earth alloy powder having a low oxygen concentration that has a risk of heat generation/ignition due to oxidation thereof in the atmosphere.

Comparative Example

Figure 4:
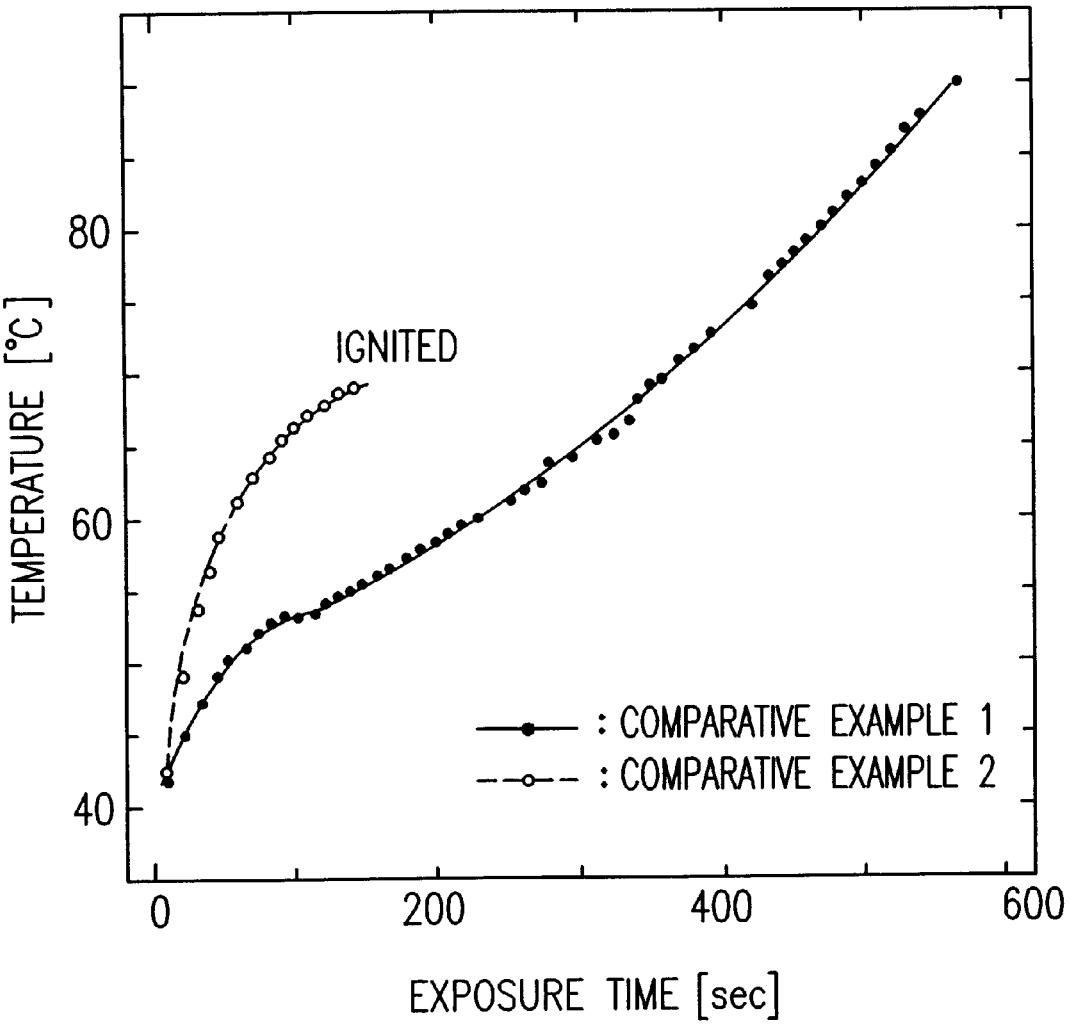
FIG. 4 is a graph showing the relationship between the elapsed time after removal of a compact from a press and the compact temperature in a comparative example.

As a comparative example, compacts were produced from material 1 and material 2 as in the above example. FIG. 4 is a graph showing the relationship between the exposure time to the atmosphere and the compact temperature for comparative examples 1 and 2 produced from material 1 and material 2, respectively.

In the comparative example, the compacts were not impregnated with an oil agent. In comparative example 1, as shown in the graph of FIG. 4, the compact temperature continued rising from immediately after the pressing and reached 90° C. before a lapse of 600 seconds, causing the risk of ignition. Heat generated by oxidation facilitates oxidation of surrounding powder particles. Therefore, once oxidation is initiated, the compact temperature sharply increases, resulting in significantly increasing the risk of ignition. A compact in such a state will be kept gradually oxidized, accumulating heat inside, even if it is stored in a case the inside of which is in an atmosphere having a comparatively low oxygen concentration. Therefore, the compact has a risk of abrupt heat generation resulting in ignition.

In comparative example 2 having an oxygen concentration of about 2000 wt. ppm or less, the compact ignited in the atmosphere about two minutes after removal from the press.

Thus, according to the present invention, the risk of heat generation/ignition can be avoided while the oxygen content of material powder is reduced. This makes it possible to increase the amount of the major phase of the rare earth magnet safely and practically, and thus improve the magnetic properties of the magnet.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

What is claimed is:

1. A method for manufacturing an R—Fe—B rare earth magnet comprising the steps of:

compacting rare earth alloy powder having an oxygen content of 4000 wt. ppm or less by dry compacting under compression to produce a compact;

impregnating the compact with an organic solvent from the surface of the compact; and sintering the compact.

2. The method of claim 1, wherein the mean particle size of the rare earth alloy powder is 10 $\mu$m or less.

3. The method of claim 1, wherein the rare earth alloy powder is placed in an inert gas atmosphere having an oxygen concentration of 5000 vol. ppm or less until the powder is filled in a cavity of a press for production of the compact.

4. The method of claim 1, wherein a vapor pressure of the organic solvent is 8 Pa or more at a temperature of 20° C.

5. The method of claim 4, wherein the temperature of the compact is reduced at least temporarily due to volatilization of the organic solvent.

6. The method of claim 1, wherein the organic solvent comprises a hydrocarbon solvent.

7. The method of claim 6, wherein the organic solvent comprises a saturated hydrocarbon solvent.

8. The method of claim 1, wherein a lubricant is added to the rare earth alloy powder before the compacting step.

9. The method of claim 1, wherein the organic solvent is substantially removed from the compact before the compact is sintered, and wherein after the removal of the organic solvent, the compact is kept from contact with the atmosphere until the compact is sintered.

10. The method of claim 9, wherein the removal of the organic solvent is performed under a reduced pressure at a temperature of 100 to 600° C. for 0.1 to 8.0 hours.

11. The method of claim 1, wherein after the compacting step, a surface temperature of the compact is measured, and the impregnation step is carried out only if the surface temperature is below a predetermined level.

12. The method of claim 11, wherein the surface temperature of the compact is measured with an infrared thermometer.

13. The method of claim 11, wherein the compact is stored in a sealable collecting box when the surface temperature of the compact is equal to or above the predetermined level.

14. The method of claim 1 or 11, wherein the impregnating step is carried out using an impregnation bath comprising openings through which the compact may be passed, the bath comprising shutters for closing the openings.

15. The method of claims 1 or 11, wherein a plurality of impregnation baths filled with the organic solvent are used, so that a predetermined number of compacts are individually put in the impregnation baths, to carry out the impregnation step.

16. The method of claim 14, wherein the impregnation bath is provided with a chiller for cooling the organic solvent.

17. The method of claim 15, wherein at least one impregnation bath is provided with a chiller for cooling the organic solvent.

18. The method of claim 14, wherein the impregnation bath is provided with a thermometer for measuring the temperature of the organic solvent.

19. The method of claim 15, wherein at least one impregnation bath is provided with a thermometer for measuring the temperature of the organic solvent.

20. The method of claim 1 or 11, wherein after the impregnating step, the compact is placed on a sintering plate in an inert atmosphere before sintering.

21. The method of claim 1 or 11, wherein after the impregnating step, the compact is stored in a sintering case in an inert atmosphere before sintering.

* * * * *